US006276116B1

(12) United States Patent
Annila et al.

(10) Patent No.: US 6,276,116 B1
(45) Date of Patent: Aug. 21, 2001

(54) METHOD AND ARRANGEMENT IN CONNECTION WITH WRAPPING OF A PIECE

(75) Inventors: Pasi Annila, Kauhajoki; Matti-Pekka Isomäki, Pojanluoma; Juha Lehtineva, Seinäjoki, all of (FI)

(73) Assignee: Pesmel Oy, Kauhajoki (FI)

( * ) Notice: Subject to any disclaimer, the term of this patent is extended or adjusted under 35 U.S.C. 154(b) by 0 days.

(21) Appl. No.: 09/452,891

(22) Filed: Dec. 2, 1999

(30) Foreign Application Priority Data

Jun. 10, 1999 (FI) ..... 991327

(51) Int. Cl.[7] ..... B65B 53/00

(52) U.S. Cl. ..... 53/556; 53/399; 53/441; 53/588; 53/211; 242/58.6; 242/79

(58) Field of Search ..... 53/389, 399, 441, 53/211, 556, 588; 242/58.6, 79

(56) References Cited

U.S. PATENT DOCUMENTS

| | | | | |
|---|---|---|---|---|
| 4,248,392 | | 2/1981 | Parry | 242/96 |
| 4,914,891 | * | 4/1990 | Suolahti | 53/399 |
| 5,400,567 | * | 3/1995 | Lindstrand | 53/399 |
| 5,797,240 | | 8/1998 | Martin-Cocher et al. | 53/399 |

FOREIGN PATENT DOCUMENTS

| | | | | |
|---|---|---|---|---|
| 196 01 668 A1 | | 1/1996 | (DE) | B65B/11/04 |
| 196 01 668 A1 | | 7/1997 | (DE) | B65B/11/04 |
| 220712-A1 | * | 5/1987 | (EP) | B65B/11/02 |
| 0 220 712 | | 5/1987 | (EP) | B65B/11/02 |
| 0 220 712 A1 | | 5/1987 | (EP) | B65B/11/02 |
| 0 237 649 A1 | | 9/1987 | (EP) | B65B/11/04 |
| 0 519 909 | | 2/1995 | (EP) | B65H/23/06 |
| 0 774 412 A1 | | 11/1996 | (EP) | B65B/11/02 |
| 0 774 412 A1 | | 5/1997 | (EP) | B65B/11/02 |
| 1 008 518 | | 6/2000 | (EP) | B65B/11/02 |
| 008518-A1 | * | 6/2000 | (EP) | B65B/11/02 |
| 2 121 001 | | 12/1983 | (GB) | B65H/75/30 |
| 5221409 | | 12/1993 | (JP) | B65B/11/04 |
| WO 90/06261 | | 6/1990 | (WO) | B65B/11/02 |
| WO-0016607 | * | 9/1999 | (WO) | B65B/11/04 |
| WO 00/16607 | | 3/2000 | (WO) | B65B/11/04 |

* cited by examiner

*Primary Examiner*—Ira S. Lazarus
*Assistant Examiner*—Hermant M. Desai
(74) *Attorney, Agent, or Firm*—Connolly Bove Lodge & Hutz

(57) ABSTRACT

Provided are an arrangement and method for changing a film roll (R) in a wrapping machine, the wrapping machine comprising at least film distribution means (3) for supplying a wrapping film (F) in a continuous web from the film roll (R) around a piece (P) to be wrapped, roll fixing means (310) fitted in the film distribution means (3) for fixing said film roll (R) in a rotatable manner and substantially in the vertical direction, crank means (2) supported in a movable manner in a frame structure (1) and arranged to transfer said film distribution means (3) around the piece (P) substantially in the horizontal direction, wherein said film distribution means (3) are also arranged to move substantially in the vertical direction, and cassette means (11) for storing at least one film roll (R) and transferring it to the film distribution means (3) for the change of the film roll (R), as well as film fixing means (120) arranged in said cassette means (11) to fix the film end (Fa). The film roll (R) is arranged to be coupled to said film distribution means (3) by means of a substantially vertical movement, and said film fixing means (120) are arranged to hold said film end (Fa) at least upon coupling said film roll (R) to the film distribution means (3) and at least during starting of the wrapping of the piece (P).

20 Claims, 6 Drawing Sheets

METHOD AND ARRANGEMENT IN CONNECTION WITH WRAPPING OF A PIECE

SUMMARY OF THE INVENTION

The present invention relates to an arrangement for changing a film roll in a wrapping machine. The invention relates also to a method for changing a film roll in a wrapping machine. Furthermore, the present invention relates to film distributing means. Also, the present invention relates to an arrangement for locating crank means in a wrapping machine.

As is well known, for wrapping of pieces, such as pallet loads and cylindrical paper rolls, wrapping devices known per se are used, which perform the wrapping by means of a wrapping film, preferably a thin and transparent stretch film made of plastic. One known wrapping device for wrapping a pallet load brought by a conveyor is presented in publication EP 0 220 712 A1, in which a film roll is arranged in film distribution means which are further arranged to be rotated around a pallet load by means of a crank. The film distribution means with the film roll are further arranged movable in the vertical direction along the handwheel to wrap the whole mantle surface of the piece. However, the presented device is not suitable for continuous production, because the film roll must always be manually changed in the film distribution means when the film roll runs out and the end of the film must be manually fixed to a locking device in a stationary position.

Furthermore, wrapping devices have been developed in which several film rolls are provided in a cassette and the change of a film roll is arranged to be automatic. One such device is presented in patent publication FI-78433, to which corresponds patent publication U.S. Pat. No. 4,914,891. In the presented embodiment, film rolls which are arranged vertically in a cassette and which also comprise a short pin for attachment, are transferred from the cassette by a horizontal movement by means of a transfer carriage to a film distribution carriage. The film distribution carriage is also provided with a set of press rolls arranged to be closed and opened against a set of stretching pulleys. The film is introduced between the sets of rolls by means of a special transfer device which grips the end of the film and brings in into a separate locking means. A film distribution carriage suitable for automatic change is also known from patent publication FI-81539, to which corresponds patent publication WO 90/06261. Problems are involved particularly in bringing and locating the film roll into the film distribution carriage as well as in arranging the bearings of the rotating film roll.

Nevertheless, there are some considerable problems in automatic wrapping devices, caused e.g. by the complexity of the operation of the devices and delays particularly in connection with the film change. Delays increase the time taken in wrapping and disturb the other steps of the production. In the device according to U.S. Pat. No. 4,914,891, delays are particularly caused by transferring the film roll by means of a transfer carriage and entering the end of the film in a locking means. Another function which is critical in view of reliability is entering the end of the film into the locking means by means of a separate transfer device. Fixing the end of the film in the cassette holder in a reliable way, detaching it from the holder by means of the transfer device, and holding, as well as fixing into the locking means and detaching from the transfer device are very difficult to arrange and lead to complex apparatuses to be controlled.

Detachment of the end of the film during the change of the film roll will cause an error situation which causes the operation of the whole wrapping apparatus to discontinue and disturbs production.

It is an aim of the present invention to present a considerable improvement to the prior art to eliminate the above-described drawbacks and particularly to make a more reliable operation of wrapping devices possible particularly in continuous, uninterrupted and even unmanned production. With the operations according to the invention, delays can be reduced, and furthermore, risks of malfunction and stoppage are reduced in comparison with prior art technology.

Several considerable advantages are achieved with the invention, to increase the reliability of the devices and also to decrease the costs or delays caused by maintenance and tie-up. In particular, it is possible to totally eliminate several precise positionings in the transfer of the film roll. By means of the invention, it is possible to abandon a transfer carriage to transfer the film roll from a cassette to the carriage. A significant advantage in view of the reliability is that it is possible to reduce the handling of the end of the film and the related transfer devices. Thanks to the invention, the control of wrapping devices is facilitated and also the manufacturing and implementation costs can be reduced.

The invention makes it possible to simplify the handling of film rolls in all steps to a considerable extent. Furthermore, the invention has the particular advantage that the bearings of the film roll can be arranged by simple means in the axle of the film roll, wherein bearings for rotation do not need to be arranged in the means for fixing the film roll. By using a roll axle, a steady, firm construction is obtained, in which it is possible to arrange several different film roll sizes and film roll qualities. Another advantage is that by means of the invention, also the design, dimensioning and use of the roll axle can be changed, if necessary, for each film roll. A particular advantage is obtained in that the fixing means in the roll axle can be utilized also in the other steps of the production, in the handling and transportation of film rolls. In the film distribution means, it is possible to apply e.g. a control roll presented in patent publication EP 0 519 909 B1, preferably a brake roll pressed against the film roll, whose operation is based on the use of eddy currents.

A particular advantage is obtained with means whereby the crank means are positioned and through which it is at the same time possible to lead the required pressurized medium e.g. to the film distribution means. By arranging the film distribution means to operate in the presented manner, pressurized medium is only needed for the change of he film roll, wherein also said means are switched on. In this way, a simpler, lighter and more reliable construction is obtained. Nevertheless, precise positioning is possible at the same time with simple means, which facilitates the control of the wrapping device and reduces the number of sensing means needed.

BRIEF DESCRIPTION OF THE DRAWINGS

In the following, the invention will be described in more detail by using an advantageous embodiment of the invention as an example, with reference to the appended drawings, in which.

DETAILED DESCRIPTION

Figure 1:
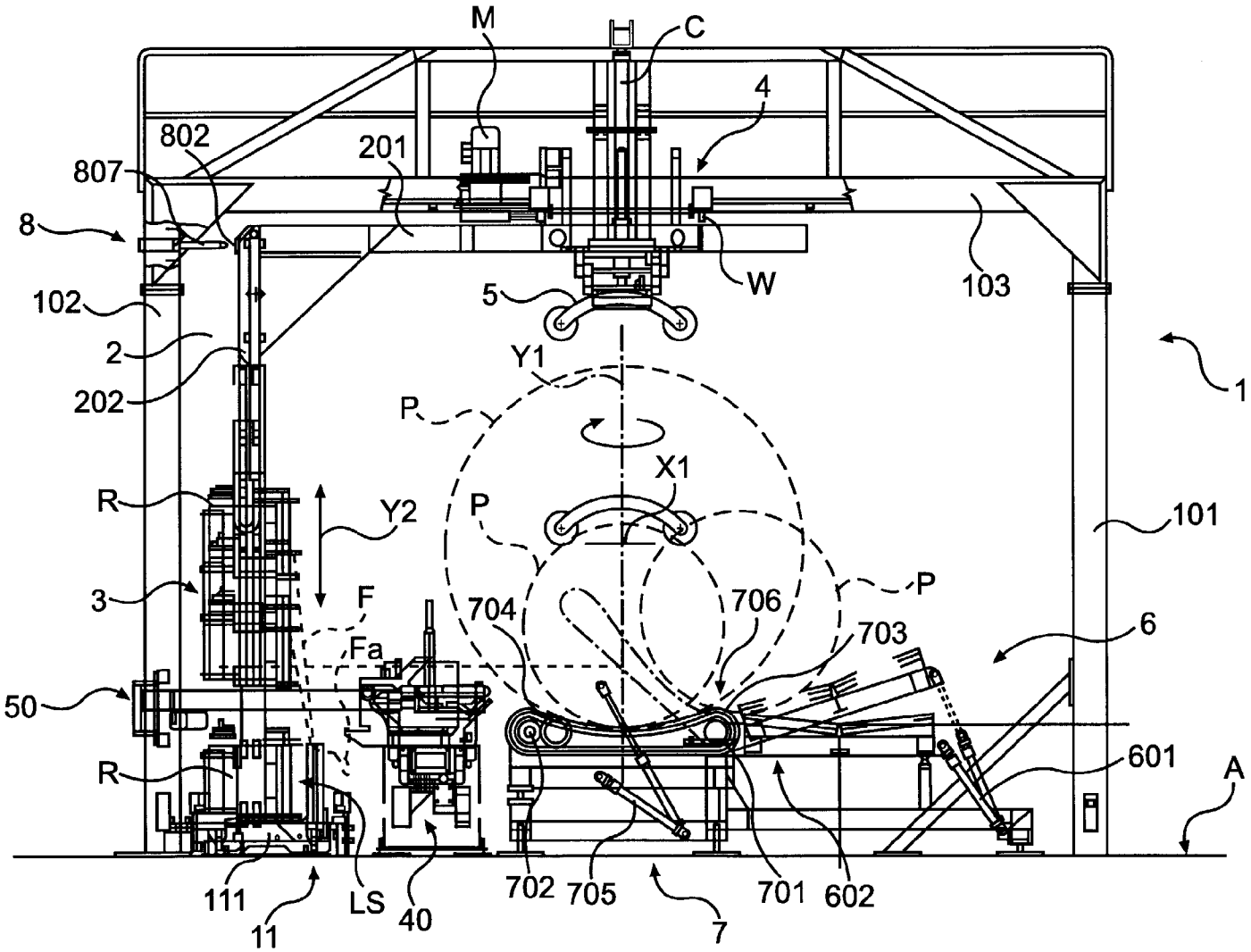
FIG. 1 shows a partly cut side view of a wrapping machine according to an advantageous embodiment for applying the invention.

The wrapping machine shown in FIG. 1 comprises a bridge-like frame structure 1 consisting of two vertical supports 101, 102 spaced from each other, and a horizontal bridge element 103. The supports 101 and 102 are placed vertically on a ground A, such as the floor of a factory. Between the supports 101, 102, and on the support of the bridge element 103, underneath the same, are located crank means 2 which transfer film distribution means 3, fixed to the same, around a piece P along a peripheral or circular path. FIG. 1 shows different positions and sizes of the piece P with a broken line. The crank means 2 comprise a horizontal arm 201, at whose outermost end is fixed a vertical arm 202 in a stationary manner. The arm 201 is fixed to the bridge element 103 in a suspended manner by means of a bearing 4, wherein the arms 201, 202 and the film distribution means 3 can be rotated along said path around a substantially vertical axis Y1. The rotational movement is implemented by means of a motor M installed in the bridge element 103 and a belt pulley W arranged in the arm 201, with the transmission of one or several belts. In the centre of the bearing 4, on said axis Y1 in the bridge element 103, a set of supporting rolls 5 is arranged, which can be moved back and forth in the vertical direction by means of a hydraulic cylinder C and which can be lowered on top of a horizontal roll P to be wrapped in the wrapping machine, to support the roll P when it rotates in its place around its substantially horizontal longitudinal axis X1 which is located perpendicular to the plane of drawing, The film distribution means 3 are arranged to be movable in the arm 202, wherein, by means of actuators (not shown in the figure) arranged in the arm 202, they can be transferred in a controlled manner back and forth and to the desired height in the vertical direction Y2. Thus, during wrapping of rolls P of different sizes, the film roll R located in the film distribution means 3 can be transferred to the level of the horizontal longitudinal axis X1 of the roll P, or a stationary pallet load can be wrapped on its whole surface by moving the film roll R from the level of the lower edge of the pallet load to the level of the upper edge, or vice versa. The wrapping machine also comprises conveyor means 6 arranged on a ground A, such as a roller, belt or slat conveyor, to bring the piece P for wrapping and to remove it after the wrapping. Said conveyor means 6 are arranged to be tilted by an actuator 601 around a joint 602 to the side, to move the roll P, such as a paper roll, to rotating means 7. The rotating means 7 comprise a belt 703 arranged around and between two rolls 701 and 702, the roll P being placed on top of the belt 703. The rolls are rotated by means of a motor 704, the movement being transferred to the belt 703 and making the roll P rotate substantially in its place around its horizontal longitudinal axis X1. The rotating means 7 are placed on the ground A and arranged to be tilted by an actuator 705 around a joint 706 to the side, wherein the roll P can be rolled back to the conveyor means 6. For example when pallet loads or rolls are wrapped in the vertical position, the piece is kept on top of the conveyor means 7 during the wrapping. A requirement for the wrapping is, however, that the piece to be wrapped is brought entirely inside said circumferential path, preferably to its centre on the rotational axis Y1 of the crank means 2.

FIG. 1 also shows cassette means 11 which are arranged preferably for storing several film rolls R and transferring them to the film distribution means 3 for an automatic change of the film roll R. In the change, the crank means 2 and thereby also the film distribution means 3 are positioned by a positioning means 8 fixed at the upper end of the support 102. The positioning means 8 comprises a bar-like element 801 which in the protruded position matches a counterpart means 802 formed in the arm 201 or 202 and thus locks the crank means 2 in their position. The crank means 2 have first been stopped at the location of the positioning means 8, but by means of the bar-like element 801 the crank means 2 are positioned more accurately for the change of the film roll R and for the positioning of the cassette means 11. The cassette means 11 comprise an integrated carriage 111 which is arranged to move back and forth in the direction perpendicular to the plane of drawing.

During the wrapping, the bar-like element 801 is withdrawn. It is also possible to lead pressurized medium, such as pressurized air for the functions of the actuators, through the bar-like element 801 to the film distribution means 3. The bar-like element 801 and the counterpart means 802 are thus fixed to each other and constitute a preferably leaklessly closed structure which can be opened by pulling out the element 801. The elements 801 and 802 are preferably provided with an arrangement corresponding to the function of fast couplings, known as such, which closes the route of the pressurized air in a spring-like manner and opens said route when the elements 801 and 802 are pushed together. The advantage is here that pressurized air does not need to be led through the joint 4 or a separate source of pressurized medium does not need to be arranged in the crank means 2. The film distribution means 3 are preferably arranged to operate in such a manner that they only need pressurized medium in connection with the change of the film roll R.

Figure 5:
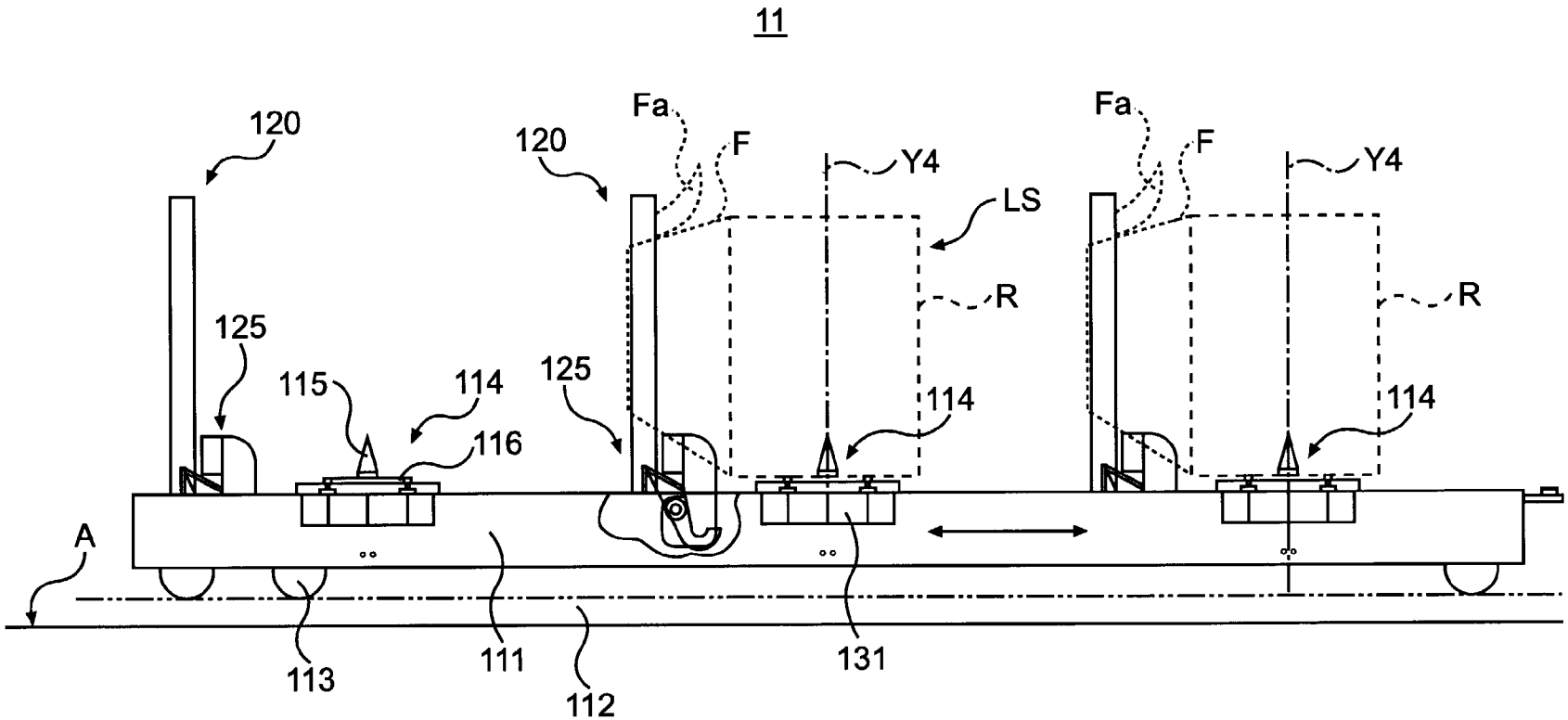
FIG. 5 shows a partly cut side view of cassette means in the wrapping machine according to FIG. 1.
Figure 6:
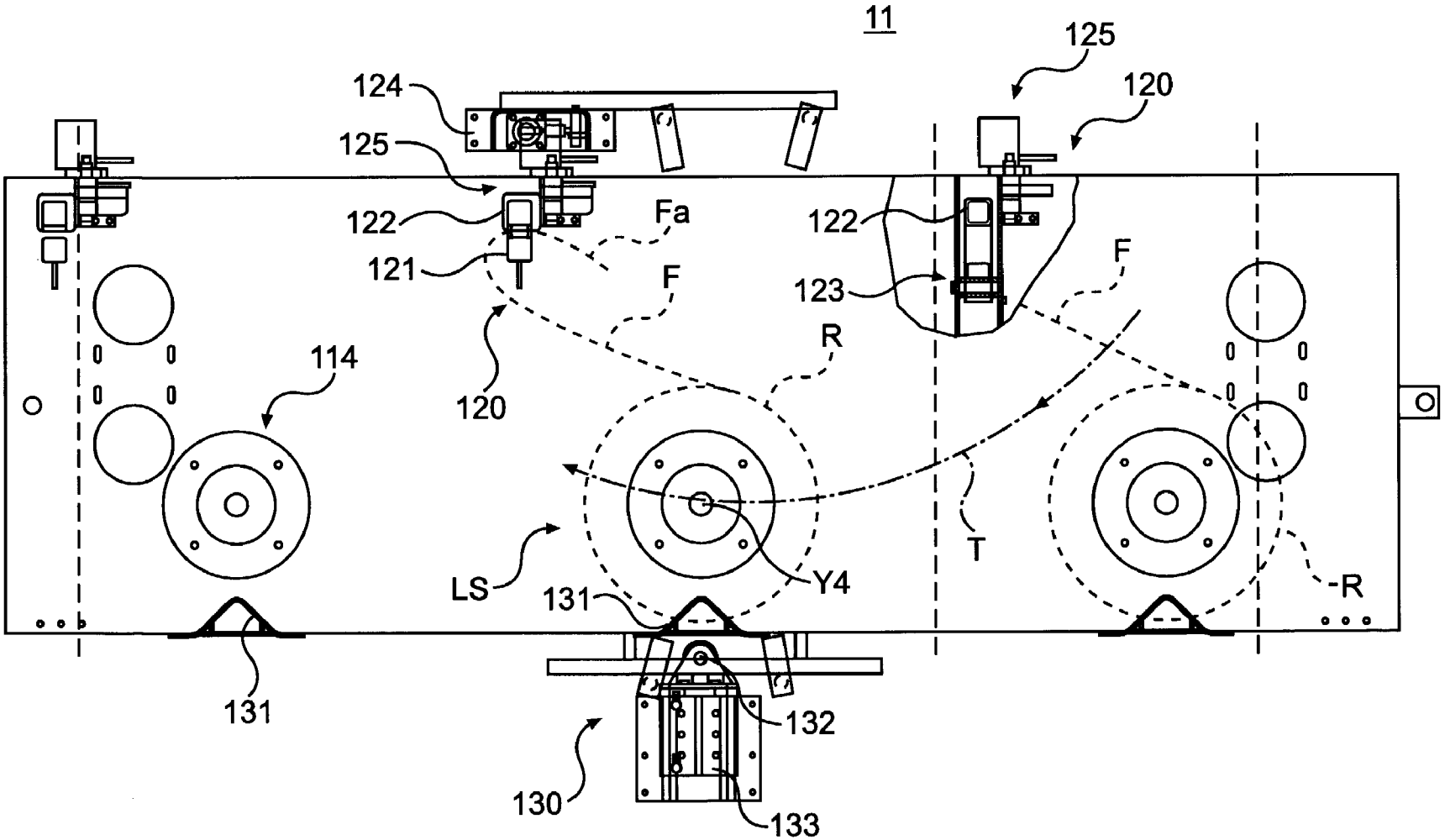
FIG. 6 shows a partly cut top view of the cassette means according to FIG. 5.

The cassette means 11 are illustrated in more detail in FIGS. 5 and 6. It should be noted that the vertical axes Y3 and Y4 of the film roll R in the film distribution means 3 (FIG. 2) and of the film roll R in the cassette means 11 (FIG. 5), particularly the paths of the vertical axes Y3 and Y4, intersect, wherein, according to the invention, the change of the film roll R can be performed simply by a vertical movement Y2 of the film distribution means 3. At the same time, the path of the film roll R in the cassette means 11 and the above-mentioned peripheral path touch each other in the horizontal plane, wherein the film distribution means 3 or the cassette means 11 do not need to be moved horizontally in the lateral direction for completing the change.

Figure 2:
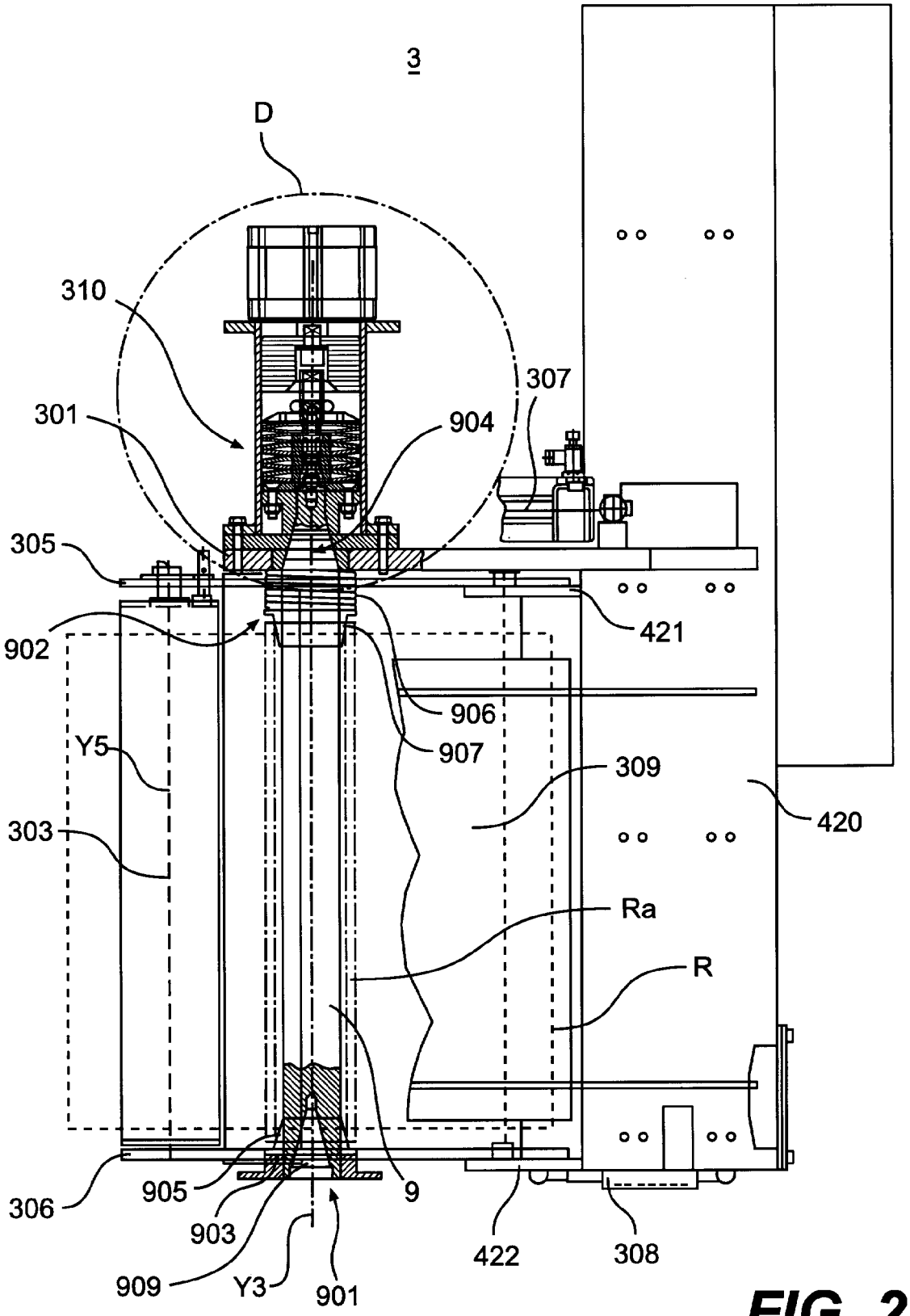
FIG. 2 is a partly cut side view of film distribution means in the wrapping machine according to FIG. 1.
Figure 3:
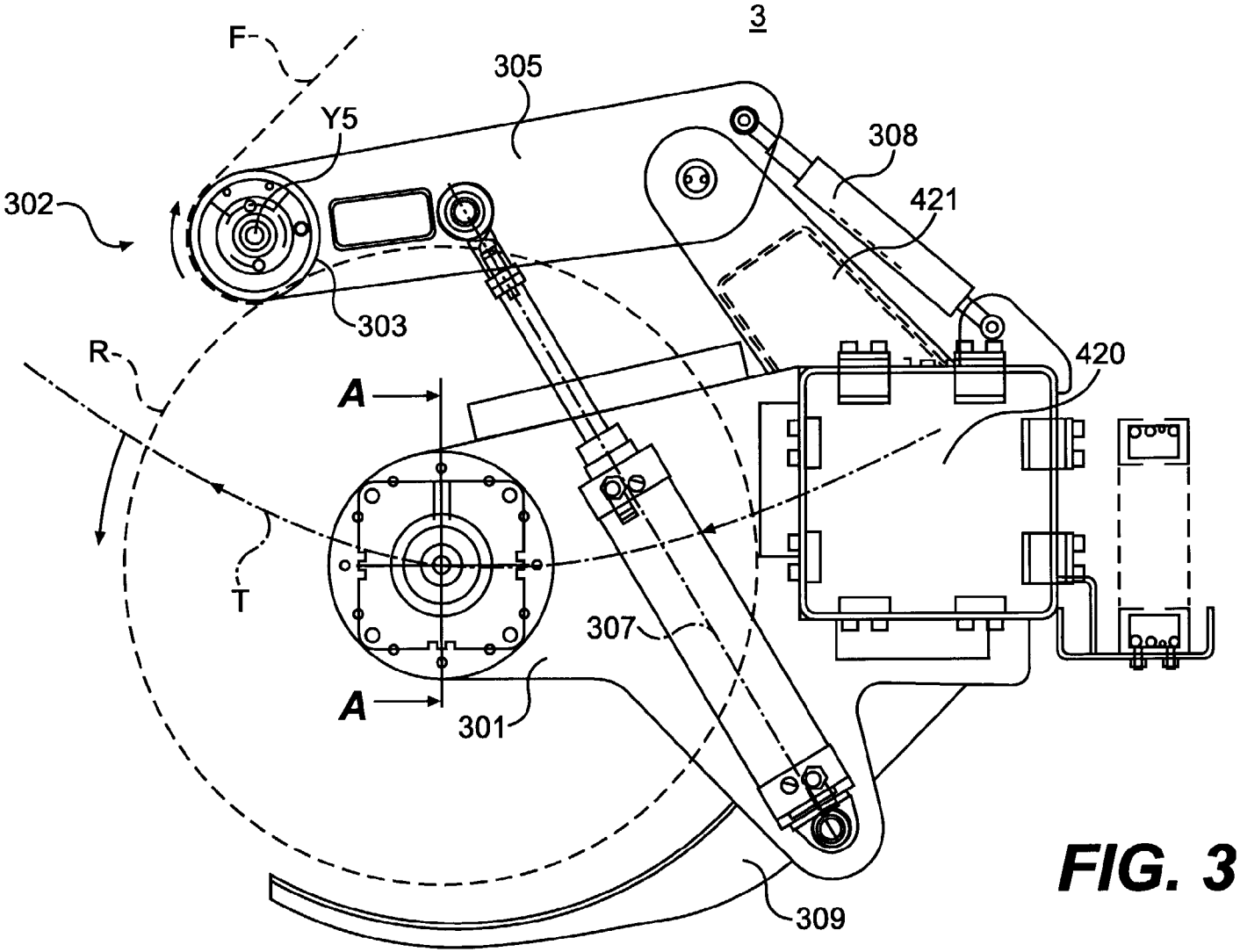
FIG. 3 shows the film distribution means according to FIG. 2 seen from above.

FIGS. 2 and 3 show the film distribution means 3 for supplying a wrapping film F and guiding it in a continuous web from the film roll R (shown with a broken line) around the piece P. The film roll R is fixed vertically to the film distribution means 3, and the film roll R is also arranged to rotate around its vertical longitudinal axis Y3. The full film roll R normally comprises a tubular core Ra which is usually made of paperboard and around which several wrapping film layers F have been wrapped in a continuous web. The film F used is normally a thin, transparent, and flexible film made of plastic. It is obvious that also various opaque, padded or protective thick films can be used as the film F. It is obvious that the piece P can be wrapped by the wrapping machine in several various film layers in different orders, the purpose of the layers being to protect the piece e.g. from moisture and impacts.

In one of the presented preferred embodiments, the fixing of the film roll R is accomplished by using a separate rolling axle 9 which can be fitted through the core Ra in the film roll R. For supporting the film roll R vertically, the first end 901 of the rolling axle 9 is equipped with means 903, preferably a flange, whose diameter is greater than the opening in the core Ra. The second end 902 of the rolling axle 9 is equipped with means 904 for coupling the film roll R and the rolling axle 9 in the vertical direction and to be suspended from roll fixing means 310 of the film distribution means 3, arranged in a flange structure 301. The flange structure 301 is substantially vertical and perpendicular to the longitudinal axis Y3.

Figure 4:
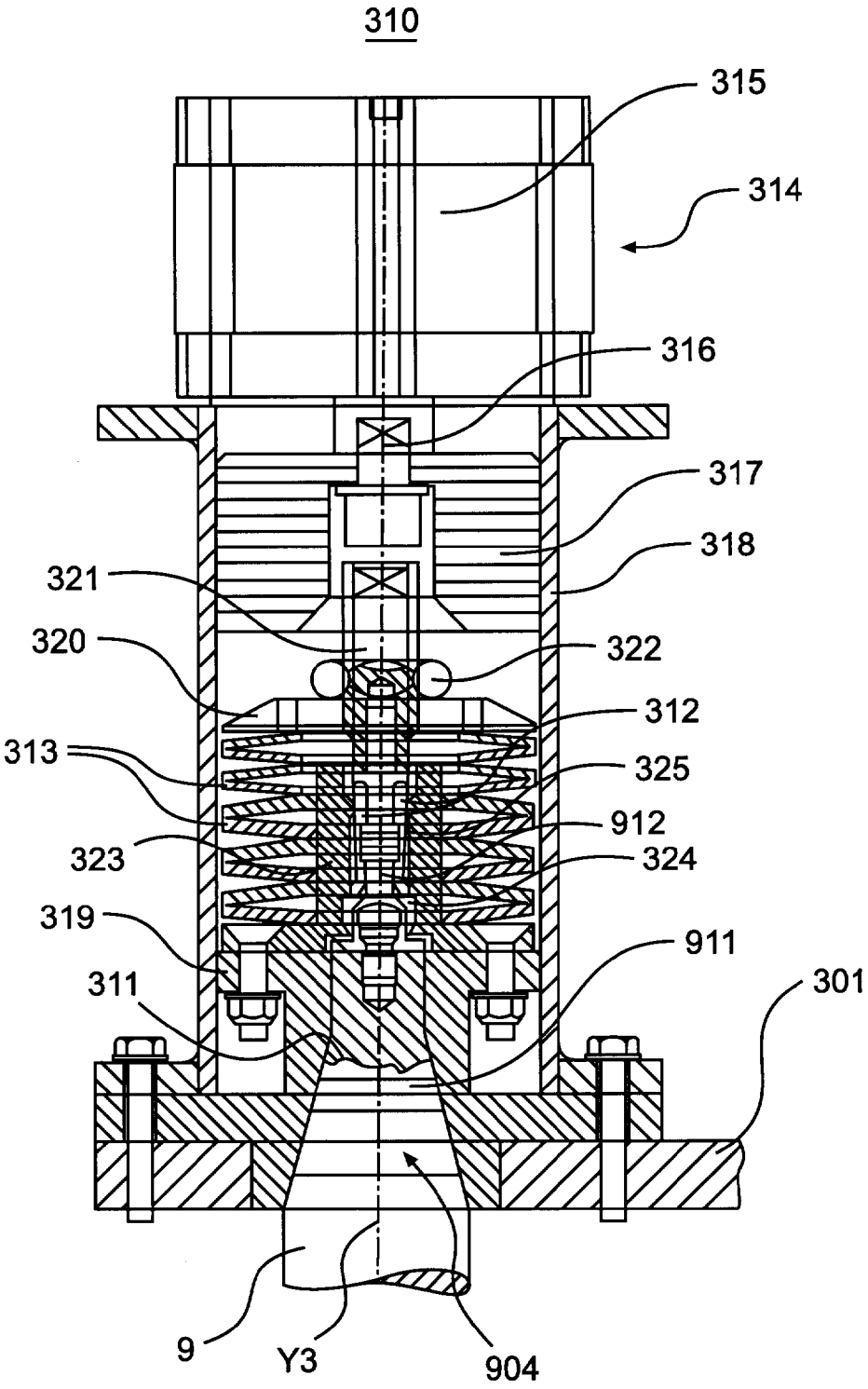
FIG. 4 shows a detail in the film distribution means according to FIG. 2, particularly roll fixing means cut from the point A—A of FIG. 3 and seen from the side.

FIG. 4 shows in detail said roll fixing means 310 as well as some of the means 904 of said rolling axle 9 at point D of FIG. 2. The means 910 preferably comprise a matching surface 911 formed in the rolling axle 9, preferably a male cone, and a drawing means 912 fitted at its end, preferably a drawing pin. The roll fixing means 310 comprise a matching surface 311, preferably a female cone, in which said male cone 911 fits when the rolling axle 9 is drawn from said drawing means 912 into the roll fixing means 310. Said roll fixing means 310 comprise jaw means 312 which fit by closing around the drawing pin 912 and which draw thee rolling axle 9 towards the female cone 311 by means of spring means 313, preferably disc springs. The jaw means 312 release the drawing pin 912 by pushing it via an actuator 314 out of the female cone 311 and by opening. The rolling axle 9 is fixed to the roll fixing means 310 in a stationary manner, and a lower bearing means, preferably a bearing retainer 905 (FIG. 2), is fitted onto the rolling axle 9, to be fitted between the core Ra and the rolling axle 9 and to support the film roll R on top of the flange structure 903. The rolling axle 9 is also equipped with a coil spring 906 and an upper bearing retainer 907 which is fitted between the rolling axle 9 and the core Ra. Supported by said bearing retainers 905 and 907, the film roll R rotates around the rolling axle 9 and its longitudinal axis Y3. The longitudinal axis Y3 is arranged in a fixed position in the film distribution means 3. The coil spring 906 is placed between the flange 301 and the bearing retainer 907, and by varying its total length, it is possible to fit film rolls R of varying height on the same rolling axle 9.

Further with reference to FIG. 4, the cones 911 and 311 are formed to be rotationally symmetrical. The actuator 314 comprises an air-driven cylinder 315 whose downwards extending piston rod 316 is equipped with a buffer bar 317. The cylinder 315 is fitted on top of a cylindrical frame 318. The film roll R is released by a downwards directed impact of the piston rod 316 on the central axis Y3, whereby the disc springs 313 are simultaneously compressed towards a solid frame part 319 in the lower part of the frame 318. The disc springs 313 are pressed by means of a stopper 320 which is also arranged to transfer the lifting thrust motion of the disc springs 313 to the jaw means 312 located on the central axis Y3 of the disc springs 313 and the frame 318. The jaw means 312, which are arranged to be movable laterally in the direction perpendicular to the axis Y3, are fixed to the lower part of a vertical arm 321. The arm 321 is equipped with an adjustable means 322, preferably a nut, underneath which the stopper 320 is placed, whereby when the arm 321 is pushed, also the disc springs 313 are compressed. At the same time, the jaw means 312 move downwards inside a control frame 323, whose lower part is provided with an expansion 324 in which the jaw means 312 can turn sideways and simultaneously release or receive the drawing pin 912. In other respects, the inner part of the control frame 323 is designed in such a way that the jaw means 312 cannot open to the lateral direction and release the drawing pin 912. The jaw means 312 are transferred and kept in the narrower upper part 325 by the expulsive force of the disc springs 313. The jaw means 312 are transferred and kept in the expanded lower part 324 by means of the expulsive force of the cylinder 315. The jaw means 312 are provided with a shoulder which is fitted in the shoulder of the drawing pin 912. The drawing pin 912 fixed in the rolling axle 9 is thus carried on the support of the shoulders in the upper part 325 of the control frame 323. The shoulders are shaped in such a way that when the jaw means 312 are transferred in said expansion 324, the drawing pin 912 opens the jaw means 312 and the rolling axle 9 is thus released from the roll fixing means 310. The rolling axle 9 is fixed in such a way that the drawing pin 912 is guided upwards, past the shoulders of the opened jaw means 312, after which the jaw means 312 can be pulled upwards, wherein they are simultaneously fitted underneath the shoulders of the drawing pin 912 and pull the rolling axle 9 by means of the drawing pin 912. The drawing pin 912 is preferably a separate means fixed at the end of the rolling axle 9 e.g. by means of a threading. Said control frame 323 is fixed on top of the flange-like frame part 319, and the frame part 319 is further fixed on top of the flange 301. The female cone 311 is arranged in the frame part 319 to open downwards. The above-described elements are primarily placed on the axis Y3 to be protected inside the tubular frame 318 and to constitute a compact integrated structure. The first end of the frame 318 is provided with said actuator 314 and the second end is provided with said female cone 311. The drawing means 912, the jaw means 312, the matching surfaces 311, 911, and the rolling axle 9 are fixed in the roll fixing means 310 by means of a movement in the direction of the longitudinal axis Y3.

With reference to FIGS. 2 and 3, the film distribution means 3 also comprise adjusting means 302 for guiding the wrapping film F and for adjusting the tension. In the presented embodiment, the adjusting means 302 comprise a control roll 303 pressed against the film roll R, preferably a damping roll which is arranged to be vertical and to rotate around its longitudinal axis Y5. The adjusting means 302 can also comprise a roll system comprising several rolls, through which the wrapping film F is conveyed. The control roll 303 is fitted with bearings between two flanges 305, 306, which are also arranged to be movable with an actuator 307, preferably a cylinder, into an opened position, whereby the film F can be set in the adjusting means 302 and the film roll R can be fitted in the roll fixing means 310, as well as into a closed position according to FIGS. 2 and 3, whereby the adjusting means 302 and the film F are set ready for wrapping. In the presented embodiment, the control roll 303 is in the opened position separate and distant from the film roll R and in the closed position in contact with the film roll R, wherein the film F runs from the film roll R, between the film roll R and the control roll 303 onto the control roll 303, through which it is supplied around the piece P or to film fixing means 120 to be described below. The control roll 303 is also pressed by means of a gas spring 308. The film distribution means 3 are also equipped with a curved and vertical protective plate 309.

With reference to FIGS. 2 and 3, the flange structure 305 and 306 is fixed to a vertical hollow beam structure 420 to receive a vertical arm 202 of the crank means 2 to be used as a guide. The beam structure is arranged to be movable in the vertical direction Y2 in relation to the arm 202 and by means of a suitable transmission (not shown in the figure), e.g. by remans of a cable transmission or a tie rod. To said beam structure 420 are also fixed bearing lugs 421 and 422, fitted in a stationary position, for the flanges 305, 306 of the control roll 303, as well as said protective plate 309.

FIGS. 5 and 6 show cassette means 11 for storing three film rolls R (two of which are shown by broken lines) and for transferring them to the film distribution means 3 for automatic change. According to an advantageous embodiment, the cassette means 11 comprise a carriage 111 moving by means of wheels 113 on the support of guides 112 fitted on top of the ground A. The carriage 111 is arranged to move back and forth in the horizontal direction. On the upper surface of the carriage 111, a positioning means 114 is fitted for the film roll R, wherein the film roll R is placed on top of the positioning means 114 substantially in the vertical direction. The positioning means 114 comprises a conical pin 115 which is fitted in a cone 909 fitted at the first end 901 of the rolling axle 9 (FIG. 2), as well as a flange part 116, the rolling axle 9 resting on its sopport. The rolling axle 9 with the film roll R can be placed in and removed from the positioning means 114 by means of a vertical movement. The carriage 111 is also provided with film fixing means 120 for fixing the film end Fa. Said film end Fa is the free end of the wrapping film F of the film roll R fitted in the positioning means 114, and upon loading, it is drawn from the roll R into the film fixing means 120. The film fixing means 120 comprise two vertical, rod-like jaws 121 and 122 to be pressed against each other. The fixing can be improved by means of a friction means, such as a rubber, attached to the rod 121 or 122. In the presented embodiment, the second rod 122 is fixed by a joint 123 under the carriage 111 so that the rod 122 could be opened at a desired moment under the control of an actuator 124. The actuator 124, preferably a cylinder, is pushed upwards and acts on a latch 125 to open the same. The latch 125 keeps the jaws 121 and 122 locked. The rod 122 can be closed manually by means of the mechanical latch 125 in connection with loading of the roll R. The film fixing means 120 are arranged in the carriage 111 in such a way that said latch 125 can be opened by means of a separate actuator 125 fitted in a stationary position at a suitable location outside the carriage 111.

The carriage 111 is also equipped with positioning means 130, preferably a recess 131, in which a separate positioning head 132 fitted in a stationary position at a suitable location outside the carriage 111 is positioned by a horizontal push by an actuator 133. The positioning means 130 place the vertical axis of the positioning means 114 (the middle positioning means 114 in FIGS. 5 and 6), with which also the longitudinal axis of the roll R and the longitudinal axis of the rolling axle 9 coincide, and the vertical axis Y3 (FIG. 2), which also coincides with the vertical symmetry axis of the roll fixing means 310, to be as uniform as possible for the change of the film roll R. With reference to the FIGS. 3 and 6, the axes Y3 and Y4 are thus located parallelly one upon the other. This takes place in a so-called change station LS. Thus, in automatic change of a full or empty film roll R, only a vertical movement back-and-forth is necessary. It should be mentioned that an empty film roll R refers primarily only to the core Ra which can be fitted with the rolling axle 9 and from whose circumference the wrapping film F has been moved around a piece P during the wrapping.

To enable continuous automatic production as long as possible, the carriage 111 is provided with several positioning means 114 for film rolls R and separate film fixing means 120 for each film roll R. According to a second advantageous embodiment, the cassette means 11 are arranged in the form of a rotating table, in which the film rolls R are fitted in a circular form. According to a third advantageous embodiment, the cassette means 11 comprise several carriages or pallets running on a predetermined path, along a conveyor path or rails, and moving in their turn to a change station LS.

The location or position in which said transfer of a full film roll R to the film distribution means 3 and the transfer of an empty film roll R back to the cassette means 11 takes place, is called a change station LS in which the cassette means 11, the film distribution means 3 and particularly the film roll R are in a certain position with respect to each other. In the change station LS, according to an advantageous embodiment of the invention, the film end Fa is fixed by the film fixing means 120 in a location which is inside the above-mentioned peripheral, usually circular path T, which is also marked in FIGS. 3 and 6. The radius of the path depends on the extension and structure of the crank means 2. Also, said control roll 303 is arranged inside the path T in such a way that when the film roll R is moved around the piece P clockwise, the film roll R rotates around its axle Y3 counter-clockwise and the control roll 303 rotates around its axle Y5 clockwise. The film end F1 is also fixed in such a position and at such a height that in the change position LS, when the control roll 303 is moved in the closed position against the film roll R, the section of the film F between the film roll R and the film end Fa is automatically placed correctly therebetween for wrapping and its starting phase.

We shall next review the use and operation of the arrangement according to an advantageous embodiment of the invention in wrapping. The automatic operation is controlled with a control system which is connected to sensors for detecting the status of the wrapping machine and the position and location of the means, as well as to actuators and motors for timing and coordinating their operation. For example, full film rolls R are manipulated in a separate loading station, wherein said rolling axle 9 with the beating means 905 and 907 is placed in the core Ra of a film roll R, and the film rolls R with their rolling axles 9 are placed in the cassette means 11 on the carriage 111. At the same time, the film end Fa is drawn from the film roll R into the film fixing means 120 and fixed to the same. After the loading, the cassette means 11 move the first film roll R to the change station LS where it is substantially in the vertical position, and position it as precisely as possible by using said positioning means 130.

The film distribution means 3 are transferred and positioned by said crank means 2 above the change station LS. The accurate, final positioning is performed by using a rod-like positioning means 801 which extends into the vertical arm 202. After the positionings, the vertical axis Y4 of the film roll R is set on the axis Y3 of the roll fixing means 310. With the adjusting means 302 opened, the film distribution means 3 are lowered towards the film roll R in the carriage 111, wherein the rolling axle 9 is fitted into the cone 311 of the roll fixing means 310. The roll fixing means 310 grip the drawing pin 912 and pull it simultaneously when fitting the rolling axle 9 with the film roll R precisely and immovably in the film distribution means 3. The control roll 303 is transferred to its closed position, and the film distribution means 3 are lifted to the wrapping height. Simultaneously the film end Fa is still kept locked. For starting the wrapping, the rod-like positioning means 801 is pulled out and the crank means 2 are used to start the rotation of the film distribution means 3 around the piece P along a peripheral path T. For example, a horizontal roll P is simultaneously rotated in its position around its longitudinal axis X1. The film end F1 being still fixed, the film F is supplied form the roll R around the piece P to which it preferably also adheres by means of friction. During or immediately after the first rotation, the film end Fa can be detached and the wrapping can be continued. When the wrapping is continued, the film end Fa is placed underneath new layers of the wrapping film on the piece P.

When the film roll R is emptied during the wrapping, said film distribution means 3 are positioned to said change station LS in the above-described manner. The empty film roll R or core Ra with the rolling axle 9 is returned by a vertical movement to its previous position in the carriage 111, wherein the carriage 111 does not need to be moved for the change. The control roll 303 is thus in its opened position. The fixing of the roll fixing means 310 is opened and the rolling axle 9 is released, after which the film distribution means 3 can be lifted off the way and a new full film roll R can be moved by the carriage 111 to the change position LS. After this, the film roll R can be transferred to the film distribution means 3 in the above-described manner to continue the wrapping.

It is obvious for anyone skilled in the art that the invention is not restricted solely to the advantageous embodiments presented above but it can vary within the scope of the claims. For example, the cassette means 11 can be fitted with means for lifting the film roll into the film distribution means 3, but in a simpler manner the vertical movement is arranged in the film distribution means 3 which will require the vertical movement also otherwise for wrapping various pieces P. In addition to this, the cassette means 11 can be fitted with positioning means for keeping the rolling axle 9 in the horizontal position, and also with means for turning the rolling axle 9 with the film roll R to a vertical position in the change station LS, but it is simpler to move the film rolls R vertical already. Moreover, delays are caused by turning the rolling axle 9 which may delay the wrapping. The flange-like part 301 of the film distribution means 3 can be arranged to rotate around a vertical axis in the same way as the control roll 303, wherein with the crank means 2 positioned, the roll fixing means 310 are turned to the change station LS and after this the lowering in the vertical direction and the coupling of the rolling axle 9 take place. However, the turning causes an extra delay in the change and makes the structure of the film distribution means 3 and their control more complicated, as well as increases the weight of the film distribution means 3.

According to an advantageous embodiment, the wrapping machine is equipped with a wrapping device 40 for radial wrapping of a horizontal roll P, wherein the device according to FIG. 1 is used for wrapping in the axial direction. In said wrapping device 40, the film distribution means are equipped to move horizontally in the longitudinal direction of the roll P and the film roll R is arranged to be horizontal, wherein its longitudinal axis is parallel with the axis X1. Thus, the roll P is thus rotated around its longitudinal axis X1 to draw the film around the piece. The device according to FIG. 1 is normally also equipped with a movable gripping means 50 which is fitted in a turnable arm and is fixed, if necessary, to the film F running from the film distribution means 3 to the piece and cuts the film F, if necessary, to stop the wrapping. The film F running from the film distribution means 3 remains fixed to the gripping means 50, and the piece P can be removed from the wrapping machine to bring a new piece P for wrapping on a belt 703. Thus, the same film roll R can be used to wrap several pieces P without interruption. New wrapping is started by moving the film F with crank means 2 around the piece P, and at a desired moment, the film end Fa is released from the gripping means 50.

The presented film distribution means 3 and roll fixing means 310 can also be applied in wrapping machines other than the presented wrapping machine equipped with crank means 2 for performing radial wrapping of a vertical piece and axial wrapping of a horizontal piece. The invention can also be applied in connection with known film distribution means fitted in carriages moving back and forth in the horizontal plane. These wrapping machines are suitable for radial wrapping of a horizontal piece, when a piece, such as a paper roll, is rotated around its horizontal longitudinal axis. However, on the basis of the above description it is obvious to apply the invention in connection with the devices in question. Furthermore, the invention can be applied in such a way that said rolling axle 9 is fitted outside the film roll R, wherein said rolling axle 9 is equipped with means for supporting the film roll in a movable manner. Said Means can comprise means corresponding to the rolling axle 9 and its bearing means for arranging the longitudinal axis of the film roll R to the side of the central axis Y3 of the roll fixing means 310. Thus, the film roll R can also be arranged to be transverse in relation to the rolling axle 9.

It is obvious that the rolling axle 9 and the roll fixing means 310 can also be arranged in a horizontal or slanted position, but preferably they are vertical, wherein no bending forces are developed in the rolling axle 9 and the film roll can be removed and set with the help of gravity without separate transfer devices. The vertical film roll R with the rolling axle 9 can also be fixed easily by means of a mere vertical movement of the film roll R and/or the roll fixing means 310. According to an advantageous embodiment of the invention, both ends of the rolling axle 9 are provided with a matching surface 911 and a drawing means 912, wherein the rolling axle can be fixed in a locked manner e.g. in the cassette means 11.

What is claimed is:

1. Arrangement in a wrapping machine for changing a film roll (R), the wrapping machine comprising at least:

film distribution means (3) for supplying a wrapping film (F) in a continuous web from the film roll (R) around a piece (P) to be wrapped, wherein said film distribution means (3) are equipped with roll fixing means (310) for fixing said film roll (R) in a rotatable manner and substantially in the vertical direction, and wherein said film distribution means (3) are also equipped with adjusting means (302) for adjusting the tension of the wrapping film (F), a frame structure (1), and crank means (2) which are supported in a movable manner in said frame structure (1) and are arranged to transfer said film distribution means (3) around the piece (P) substantially in the horizontal direction, wherein said film distribution means (3) are also arranged to move substantially in the vertical direction, cassette means (11) for storing at least one film roll (R) and transferring it to the film distribution means (3) for the change of film roll (R), as well as film fixing means (120) arranged in said cassette means (11) to fix the film end (Fa), wherein said film roll (R) is arranged to be coupled to said film distribution means (3) by means of a substantially vertical movement, and that said film fixing means (120) are arranged to hold said film end (Fa) at least upon coupling said film roll (R) to the film distribution means (3) and at least during starting of the wrapping of the piece (P).

2. Arrangement according to claim 1, wherein said cassette means (11) are arranged to position said film roll (R) in a change station (LS) substantially in the vertical direction, said crank means (2) are arranged to position said film distribution means (3) above said change station (LS) in such a way that said film roll (R) is fitted to said roll fixing means (310) by means of a substantially vertical movement of the film roll (R) and/or the film distribution means (3), and said film fixing means (120) are arranged to keep said film end (Fa) fixed at least when said film roll (R) is being fitted to the film distribution means (3) and at least during starting of the wrapping of the piece (P), and that said film fixing means (120) are also arranged for releasing said film end (Fa) during wrapping of the piece (P).

3. Arrangement according to claim 2, wherein said crank means (2) are arranged to position said film distribution means (3) above said change station (LS) to return the film roll (R) emptied during the wrapping to the cassette means (11) by means of a substantially vertical movement of the film distribution means (3) and/or the cassette means (11).

4. Arrangement according to claim 1, wherein it also comprises a rolling axle (9) which is fitted on the longitudinal axis of said film roll (R) and whose first end (901) is equipped with means (903) for supporting said film roll (R) and whose second end (902) is equipped with means (904) for coupling said rolling axle (9) to said roll fixing means (310), and that said rolling axle (9) is equipped with bearing means (905, 907) for allowing rotation of said film roll (R).

5. Arrangement according to claim 4, wherein said cassette means (11) are equipped with positioning means (114) fitted at the first end (901) of said rolling axle (9) for supporting said rolling axle (9) and the film roll (R) placed on said rolling axle (9).

6. Arrangement according to claim 1, wherein said film fixing means (120) comprise two rod-like, substantially vertical jaws (121, 122) fitted in said cassette means (11) and pressed against each other for locking the film end (Fa) therebetween, wherein at least one of the jaws (121, 122) is arranged to be movable.

7. Arrangement according to claim 1, wherein said cassette means (11) comprise an integrated carriage (111) which moves back and forth in a substantially vertical plane and in which at least two film rolls (R) can be fitted, and which is provided with said film fixing means (120) separately for each film roll (R).

8. Arrangement according to claim 1, wherein said cassette means (11) comprise a table rotating around a substantially vertical direction, on the circumference of which at least two film rolls (R) are arranged to be fitted and which is provided with said film fixing means (120) separately for each film roll (R).

9. Arrangement according to claim 1, wherein said cassette means (11) comprise at least two carriages movable in a substantially vertical plane, one film roll (R) being arranged to be fitted in each carriage and said film fixing means (120) being arranged in the carriage.

10. Arrangement according to claim 1, wherein said adjusting means (302) comprising at least one control roll (303) are arranged to be transferred in the opened position to fit said film roll (R) in said roll fixing means (310), and that said adjusting means (302) are arranged to be transferred to a closed position for wrapping when said film end (Fa) is fixed to said film fixing means (310).

11. Method for changing a film roll in a wrapping machine, the wrapping machine comprising at least:

film distribution means (3) for supplying a wrapping film (F) in a continuous web from the film roll (R) around a piece (P) to be wrapped, wherein said film distribution means (3) are equipped with roll fixing means (310) for fixing said film roll (R) in a rotatable manner and substantially in the vertical direction, and wherein said film distribution means (3) are also equipped with adjusting means (302) for adjusting the tension of the wrapping film (F), a frame structure (1), and crank means (2) which are supported in a movable manner in said frame structure (1) and are arranged to transfer said film distribution means (3) around the piece (P) substantially in the horizontal direction, wherein said film distribution means (3) are also arranged movable substantially in the vertical direction, cassette means (11) for storing at least one film roll (R) and transferring it to the film distribution means (3) for the change of the film roll (R), as well as film fixing means (120) arranged in said cassette means (11) to fix the film end (Fa), wherein said cassette means (11) are used to position said film roll (R) to be substantially vertical, and that said film distribution means (3) are positioned by said crank means (2) above said change station (LS), that said film roll (R) is fitted in said roll fixing means (310) by a substantially vertical movement of the film roll (R) and/or the film distribution means (3), that said film end (Fa) is held by said film fixing means (120) at least when said film roll (R) is being fitted in the film distribution means (3) and at least when the wrapping of the piece (P) is being started, and that said film end (Fa) is released from said film fixing means (120) during wrapping of the piece (P).

12. Method according to claim 11, wherein said film distribution means (3) are positioned with said crank means (2) above said change station (LS), and that said film roll (R) emptied during the wrapping is returned to the cassette means (11) by means of a substantially vertical movement of the film distribution means (3) and/or the cassette means (11).

13. Method according to claim 11, wherein a rolling axle (9) is fitted on the longitudinal axis of said film roll (R), the first end (901) of the rolling axle (9) being equipped with means (903) for supporting said film roll (R) and the second end (902) of the rolling axle (9) being equipped with means (904) for coupling said rolling axle (9) to said roll fixing means (310), and that said rolling axle (9) is equipped with bearing means (905, 907) for allowing rotation of said film roll (R).

14. Method according to claim 13, wherein said film roll (R) with the rolling axle (9) is placed in said cassette means (11), and the film end (Fa) of said film roll (R) is fixed to said film fixing means (120).

15. Arrangement for fixing a film roll (R) in a wrapping machine, the wrapping machine comprising at least film distribution means (3) for supplying a wrapping film (F) in a continuous web from the film roll (R) around a piece (P) to be wrapped, wherein said film distribution means (3) are equipped with roll fixing means (310) for fixing said film roll (R) to rotate around its longitudinal axis (Y3), wherein said roll fixing means (310) are arranged to fix a rolling axle (9) to be fitted in connection with the film roll (R), wherein the end (902) of said rolling axle (9) is equipped with a drawing means (912) for gripping, that said roll fixing means (310) comprise jaw means (312) which are arranged to be lockingly fitted into said drawing means (912) and which are arranged to fit by pulling the end (902) of the rolling axle (9) in said roll fixing means (310), and that said roll fixing means (310) are equipped with a matching surface (311) which is arranged to be compressably fitted against a matching surface (911) formed at the end (902) of the rolling axle (9) to center and lock the rolling axle (9).

16. Arrangement according to claim 15, wherein the rolling axle (9) comprises an elongated axle (9) to be fitted on the longitudinal axis (Y3) of the film roll (R) and extending through the film roll (R), the first end (901) of the rolling axle (9) being equipped with flange means (903) for supporting the film roll (R) and the second end (902) of the rolling axle (9) being equipped with said drawing means (912) and said matching surface (911), and that the rolling axle (9) also comprises a bearing means (905) fitted at the first end (901) for supporting the film roll (R) in a rotating manner on said flange means (903), and a bearing means (907) fitted at the second end (902), between the film roll (R) and the rolling axle (9).

17. Arrangement according to claim 15,wherein the drawing motion of said jaw means (312) and the maintenance of the locking of the rolling axle (9) are arranged by means of spring means (313), such as disc springs (313), and that the releasing of the rolling axle (9) from the jaw means (312) is arranged by means of an opposite movement of a controlled actuator (314), such as a cylinder (314) operated by a pressurized medium.

18. Arrangement according to claim 15, wherein the roll fixing means (310) comprise a control frame (323), said jaw means (312) being arranged to be locked and to move in the longitudinal direction (Y3) in an opening (325) through the control frame (323), wherein said opening (325) is also provided with an expansion (324) to allow the opening of said jaw means (312) and the locking.

19. Arrangement according to claim 15, wherein the film distribution means (3) are also equipped with adjusting means (302) for guiding the wrapping film (F) and adjusting the tension, wherein said adjusting means (302), comprising at least one control roll (303), are arranged to be transferred to an opened position to fit said film roll (R) in said roll fixing means (310), and that said adjusting means (302) are arranged to be transferred to a closed position for wrapping.

20. Arrangement for positioning crank means (2) in a wrapping machine, the wrapping machine comprising at least:

film distribution means (3) for supplying a wrapping film (F) in a continuous web from the film roll (R) around a piece (P) to be wrapped, and a frame structure (1), and crank means (2) supported in a movable manner in said frame structure (1), arranged to transfer said film distribution means (3) around the piece (P) in a substantially horizontal direction, wherein the frame structure (1) is equipped with a means (8) for positioning the crank means (2), the means (8) comprising a protruding element (801) arranged to move back and forth, which in the protruding position is coupled to a counterpart means (802) arranged in the crank means (2), and that when coupled, said means (8) is arranged also to lead pressurized medium to toe crank means (2) and/or to the film distribution means, (a) through said part (801) and said counterpart means (803).

* * * * *